US005666838A

United States Patent [19]

Dudick et al.

[11] Patent Number: 5,666,838

[45] Date of Patent: Sep. 16, 1997

[54] FORGING PRESS FOR USE WITH AUTOMATED MULTI-STATION TRANSPORT SYSTEM

[75] Inventors: George Michael Dudick, Northeast; Victor C. Chernauskas, Erie; Allen J. Lawrence, Edinboro, all of Pa.

[73] Assignee: EFCO, Incorporated, Erie, Pa.

[21] Appl. No.: 462,606

[22] Filed: Jun. 5, 1995

[51] Int. Cl.[6] ..... B21D 45/02

[52] U.S. Cl. ..... 72/14.8; 72/41; 72/405.11; 72/427; 72/452.5; 72/446

[58] Field of Search ..... 72/452.5, 446, 72/405.16, 405.13, 405.11, 405.09, 405.01, 404, 14.8, 41, 427; 100/257

[56] References Cited

U.S. PATENT DOCUMENTS

| | | | |
|---|---|---|---|
| 2,618,840 | 11/1952 | Danly | 72/405.12 |
| 2,790,331 | 4/1957 | Pinkvoss | 74/571 |
| 3,122,033 | 2/1964 | Riemenschneider | 100/257 |
| 3,726,123 | 4/1973 | Bothe | 72/446 |
| 3,834,216 | 9/1974 | Schiller | 72/446 |
| 3,915,312 | 10/1975 | Clark | 214/1 BB |
| 4,086,832 | 5/1978 | Korytko | 83/198 |
| 4,160,518 | 7/1979 | Scribner | 226/115 |
| 4,195,761 | 4/1980 | Scribner | 226/115 |
| 4,197,772 | 4/1980 | Anderson et al. | 83/63 |
| 4,207,999 | 6/1980 | Scribner | 226/150 |
| 4,240,778 | 12/1980 | Korytko | 425/149 |
| 4,261,238 | 4/1981 | Scribner | 83/225 |
| 4,265,385 | 5/1981 | Hills | 226/127 |
| 4,267,950 | 5/1981 | Scribner | 226/146 |
| 4,290,541 | 9/1981 | Scribner | 226/150 |
| 4,297,927 | 11/1981 | Kuroda | 83/36 |
| 4,310,114 | 1/1982 | Scribner | 226/162 |
| 4,329,897 | 5/1982 | Scribner | 83/225 |
| 4,348,144 | 9/1982 | Nelson | 414/277 |
| 4,351,462 | 9/1982 | Scribner | 226/150 |
| 4,378,592 | 3/1983 | Heiberger et al. | 364/476 |
| 4,444,346 | 4/1984 | Scribner | 226/162 |
| 4,444,380 | 4/1984 | Chambers et al. | 269/87 |
| 4,515,551 | 5/1985 | Korytko | 425/406 |
| 4,525,706 | 6/1985 | Nishikawa et al. | 340/679 |
| 4,598,894 | 7/1986 | Lingaraju et al. | 29/464 |
| 4,619,390 | 10/1986 | Scribner | 226/162 |
| 4,654,569 | 3/1987 | Mizumoto | 72/405.16 |
| 4,682,280 | 7/1987 | Schneider | 72/405.09 |
| 4,773,250 | 9/1988 | Miyazaki | 72/405 |
| 4,819,474 | 4/1989 | Gober | 72/446 |
| 4,846,014 | 7/1989 | Shiga | 100/257 |
| 4,907,436 | 3/1990 | Korytko | 72/184 |
| 4,971,515 | 11/1990 | Pol et al. | 414/797 |
| 4,990,080 | 2/1991 | Kakimoto | 425/290 |
| 5,000,027 | 3/1991 | Noda et al. | 72/405 |
| 5,023,770 | 6/1991 | Siverling | 364/140 |
| 5,046,916 | 9/1991 | Sorensen | 414/751 |
| 5,079,489 | 1/1992 | Ishii | 72/405.01 |
| 5,105,647 | 4/1992 | Maher | 72/405.13 |
| 5,199,157 | 4/1993 | Kurz et al. | 29/527.4 |

(List continued on next page.)

OTHER PUBLICATIONS

Brochure entitled, "Mechanical Forging Presses", by Erie Press Systems, 16 pages, undated.

*Primary Examiner*—Daniel C. Crane
*Attorney, Agent, or Firm*—Jacox, Meckstroth & Jenkins

[57] ABSTRACT

A hot forging press for use in closed-die hot forging operations wherein the forging press may be operated in conjunction with an automated multi-station transport sub-system to move parts through a progressive multi-station forging die. The press includes a press bed and vertically moveable ram for supporting lower and upper dies, respectively. A drive mechanism for driving the ram is provided with an adjustment system whereby the shut height of the press may be adjusted during operation of the press. A programmable logic controller is provided for controlling the press operations including the shut height adjustment, transport of parts by the transport sub-system and operation of a kickout sub-system for kicking parts out of the dies. Further, the press includes an enlarged tonnage zone whereby the full tonnage zone encompasses a plurality of the dies in their entirety.

19 Claims, 12 Drawing Sheets

U.S. PATENT DOCUMENTS

| | | | |
|---|---|---|---|
| 5,218,756 | 6/1993 | Zaleski | 29/818 |
| 5,224,053 | 6/1993 | Cook | 72/405.01 |
| 5,231,552 | 7/1993 | Schneider et al. | 360/92 |
| 5,257,899 | 11/1993 | Asakura et al. | 414/752 |
| 5,269,168 | 12/1993 | Ogawa | 72/405 |
| 5,299,351 | 4/1994 | Takahashi et al. | 29/798 |
| 5,337,594 | 8/1994 | Pettersson et al. | 72/446 |
| 5,423,202 | 6/1995 | Komatsu | 72/405.16 |

FORGING PRESS FOR USE WITH AUTOMATED MULTI-STATION TRANSPORT SYSTEM

BACKGROUND OF THE INVENTION

1. Field of the Invention

This invention relates to hot forging presses, and more particularly, it relates to a forging press for use in closed-die hot forging operations wherein the forging press can be operated in conjunction with an automated multi-station transport sub-system to move parts through a progressive multi-station forging die.

2. Description of Related Art

Closed-die forging is one of the most widely used methods of manufacturing high-strength components for the automotive, aircraft and other heavy manufacturing industries. Recent trends in production requirements are toward smaller batch quantities and a larger number of differently configured parts. Quick and easy retooling, maximum flexibility and variable production rates are becoming decisive factors in the effective use of forging equipment. In such cases, particular importance is attached to the means for transferring parts between progressive die stations of a multi-station forging die mounted in a forging press.

Conventional transfer systems in many cases are mechanically tied to the press drive mechanism or crankshaft and move in a direct relationship to the movement of the press ram. In most cases, the transfer systems get their driving force from cams which are actuated by the press ram. The cams, through mechanical linkages, accomplish all of the motions necessary to accomplish the part transfer with fixed strokes.

Conventional mechanical transfer or handling systems achieve high production rates by simultaneous loading of the die stations. However, in nearly all cases, fixed stroke transfer systems are designed in connection with a specific large volume or family of parts which have similar size and/or configurations. This is done to better utilize the equipment and to generate a larger production volume. These larger volumes are required to help amortize the high costs of the system over a greater number of parts.

A main disadvantage of mechanical equipment lies in the lack of flexibility inherent in its construction, sequencing and movement produced by means of cams linked together. Each change of stroke necessitates mechanical adjustment or replacement of the driven mechanisms. As a rule, this involves a considerable amount of time and manpower. The changeover to a new forging die frequently requires repeated setting of the mechanical adjustments while the press stands idle. Due to the fact that the cycle sequence is mechanically locked, it is usually not possible to achieve different transfer strokes.

Automation systems used in other industries have been engineered with some degree of flexibility, but are not able to withstand the harsh forging environment. High temperatures, dirt, scale and die lubricants create design problems not yet addressed by other manufacturers. Most types of forging presses presently used in manual operations are suitable for full or partial automation and some presses have been designed to allow for later retrofitting of automatic systems.

Thus, there is needed for a flexible forging press for use in closed-die forging operations which can be operated in conjunction with an automated multi-station transport sub-system to move parts through a progressive multi-station forging die.

SUMMARY OF THE INVENTION

Thus, it is a primary object of this invention to provide a forging press for use in closed-die forging operations wherein the press may be operated in conjunction with an automated multi-station transport sub-system to move parts through a progressive multi-station forging die.

It is another object of this invention to provide a forging press with a shut height adjustment sub-system which permits a forging stroke of a press ram to be real time adjusted via computer control so as to automatically compensate for the height characteristics of a multi-station progressive forging die secured to the bed of the press.

It is yet another object of this invention to provide a forging press with a hydraulic kickout sub-system which permits a kickout speed, length of kickout stroke and amount of time delay before actuating a knockout pin to be automatically adjusted via computer control so as to automatically compensate for the height characteristics of a multi-station progressive forging die secured to the bed of the press.

It is yet another object of this invention to provide a forging press with a programmable logic controller-based control system which communicates with an operator interface, the main drive components of the press, and with a plurality of automated sub-systems during a forging cycle of the press.

It is yet another object of this invention to provide a forging press with a bed that accommodates multiple forging stations, and that provides a full tonnage zone typically covering three central forging stations.

It is yet another object of this invention to provide a forging press with an eccentric shaft that transmits forging forces via a yoke mechanism uniformly across the entire surface of the dies to ensure uniform formation of parts during a downward forging stroke.

In one aspect of the invention, a forging press is provided which includes a high degree of flexibility via a programmable logic controller-base control system which enables almost instantaneous reconfiguration of the press for different jobs.

In another aspect of the invention, a forging press is provided which includes a yoke mechanism that provides for less deflection and improved forging through the press.

In still another aspect of the invention, a forging press is provided which is capable of operating to increase production from the press.

These and other objects and advantages of the invention will be apparent from the following description, the accompanying drawings and the appended claims.

DETAILED DESCRIPTION OF THE PREFERRED EMBODIMENT

Figure 1:
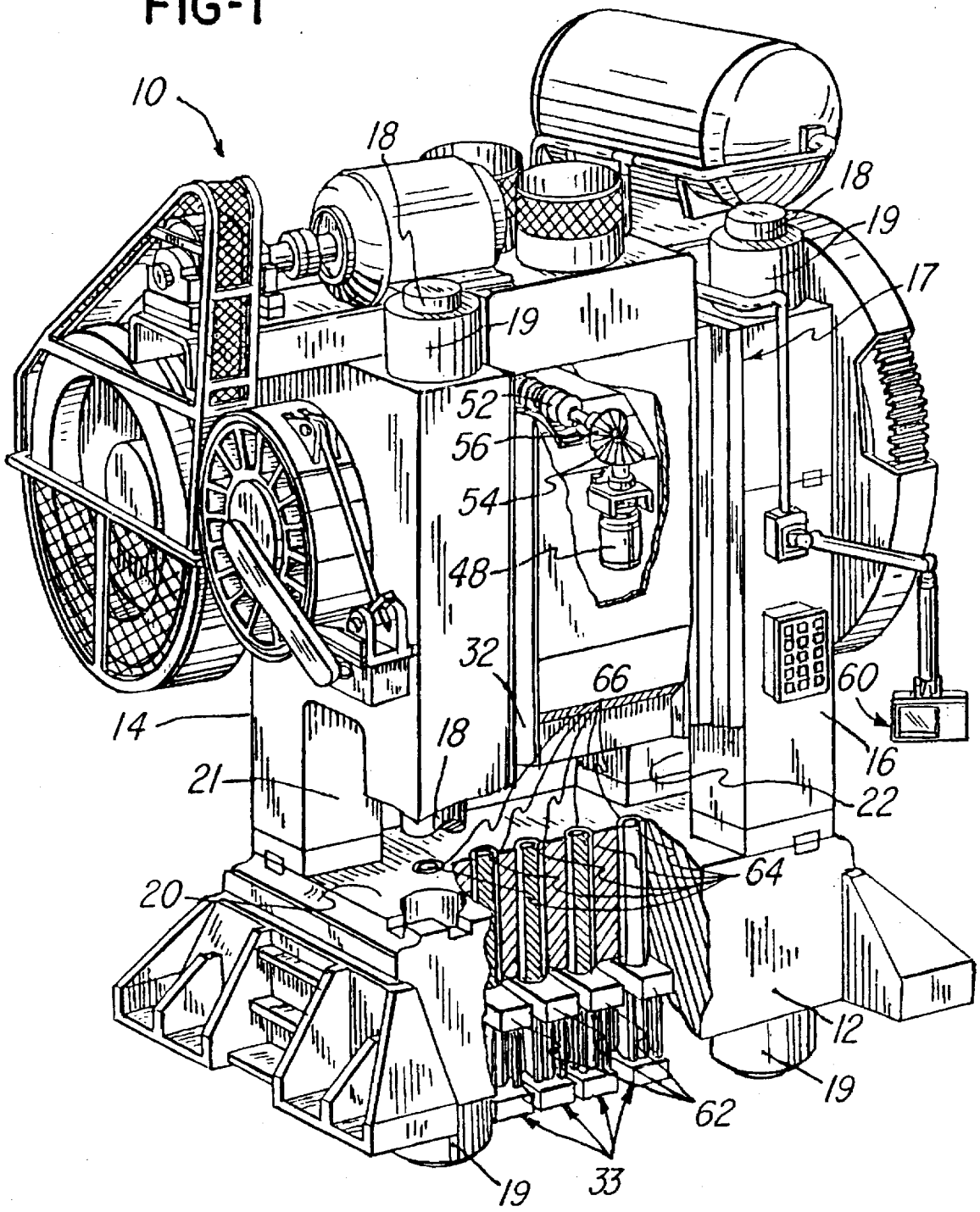
FIG. 1 is a perspective view of a forging press constructed in accordance with the present invention.

Referring now to FIG. 1, there is shown a preferred embodiment for a forging press 10 of the present invention. The press 10 includes a multi-piece steel frame comprising a forged bed 12 and two fabricated steel spaced-apart upright frame members 14, 16 secured to the bed 12, and a cast alloy steel crown 17 is secured to the frame members 14, 16. In the embodiment being described, the press 10 has a tie-rod construction wherein the frame members 14, 16 are secured to the bed 12 by a plurality of tie rods 18 and hydraulic tie rod nuts 19, wherein the tie rods 18 extend through the frame members 14, 16 and bed 12.

The bed 12 includes a machined upper surface 20 for supporting a lower member of a bottom main bolster 70 (FIG. 8) which is secured to the bed 12 during a forging operation of the press 10 and which is adapted to support bottom dies 68*a*–*d*. The frame members 14, 16 include a respective aperture or window 21, 22 which is suitable for receiving automated forging line equipment as discussed further below. In the embodiment being described, the press 10 accommodates a two-piece, multi-station die for use in progressive forging operations.

As seen in FIGS. 2–5, the press 10 includes a vertically movable main ram 32 supported between the frame members 14, 16. A yoke assembly 24 is associated with ram 32 for driving the ram 32 upwardly and downwardly relative to the press bed 12. The yoke assembly 24 includes an axially extending eccentric shaft 26, two main journal bearings 25, 27 assembled into bearing retainers 28, 29, a two-piece yoke block 30 comprising an upper half 30*a* and a lower half 30*b*, and a shut height adjustment assembly or sub-system 34.

The shaft 26 is formed along a central axis 31 and includes an eccentric portion 36, and main journal bearing areas 38, 40 disposed adjacent respective axial ends of the eccentric portion 36. The eccentric portion 36 defines a cylindrical outer surface 37 which is eccentrically offset from the central axis 31. The journal bearing areas 38, 40 define cylindrical outer surfaces which are concentric relative to the central axis 31. The journal bearings and bearing retainers 28 engage the cylindrical outer surfaces of the respective shaft portions 38, 40 to rotatably support the shaft 26 between the upper and lower frame members 14, 16 and the crown 17.

Figure 3:
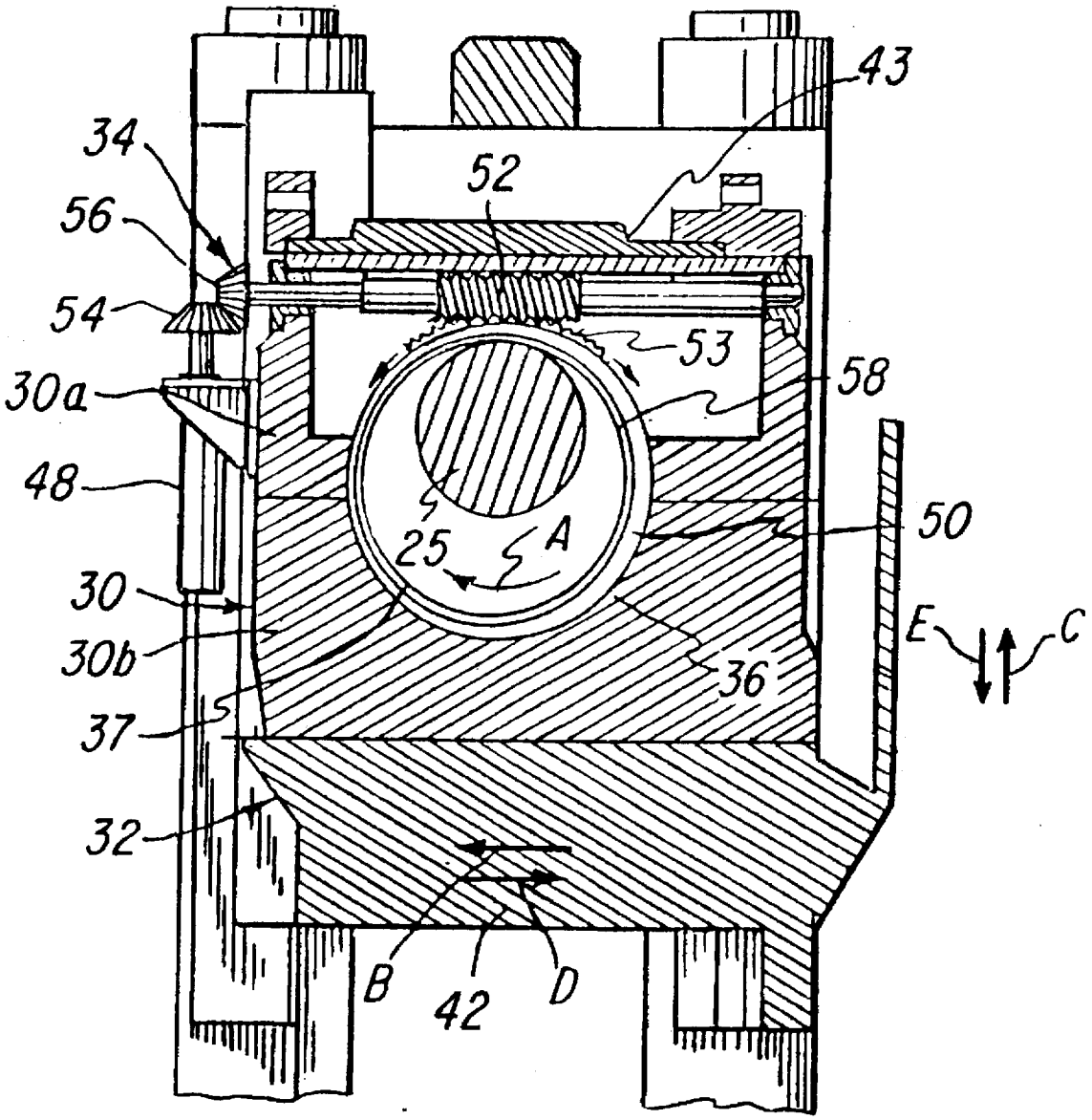
FIG. 3 is an elevational cross-sectional view of the yoke and ram assembly taken longitudinally along line 3—3 in FIG. 2.

Referring to FIG. 3, the yoke block 30 is contained within the ram 32 and moves in both horizontal and vertical directions to transmit power and motion to the ram 32 as the shaft 26, and particularly the eccentric portion 36, rotates. The yoke block halves 30*a*, 30*b* have arcuate opposing surfaces 31*a*, 31*b* which cooperate to circumferentially encase or surround eccentric portion 36. Further, replaceable bronze wear plates (not shown) are interposed between the upper block half 30*a* and a platen 42 of the ram 32 and between the lower block half 30*b* and a ram cap 43. The wear plates facilitate horizontal movement of the yoke block 30 relative to the ram 32. The lower surface of the platen 42 typically includes means for mounting a top main bolster (now shown) which is adapted to support top die members for cooperating with the bottom dies.

Figure 2:
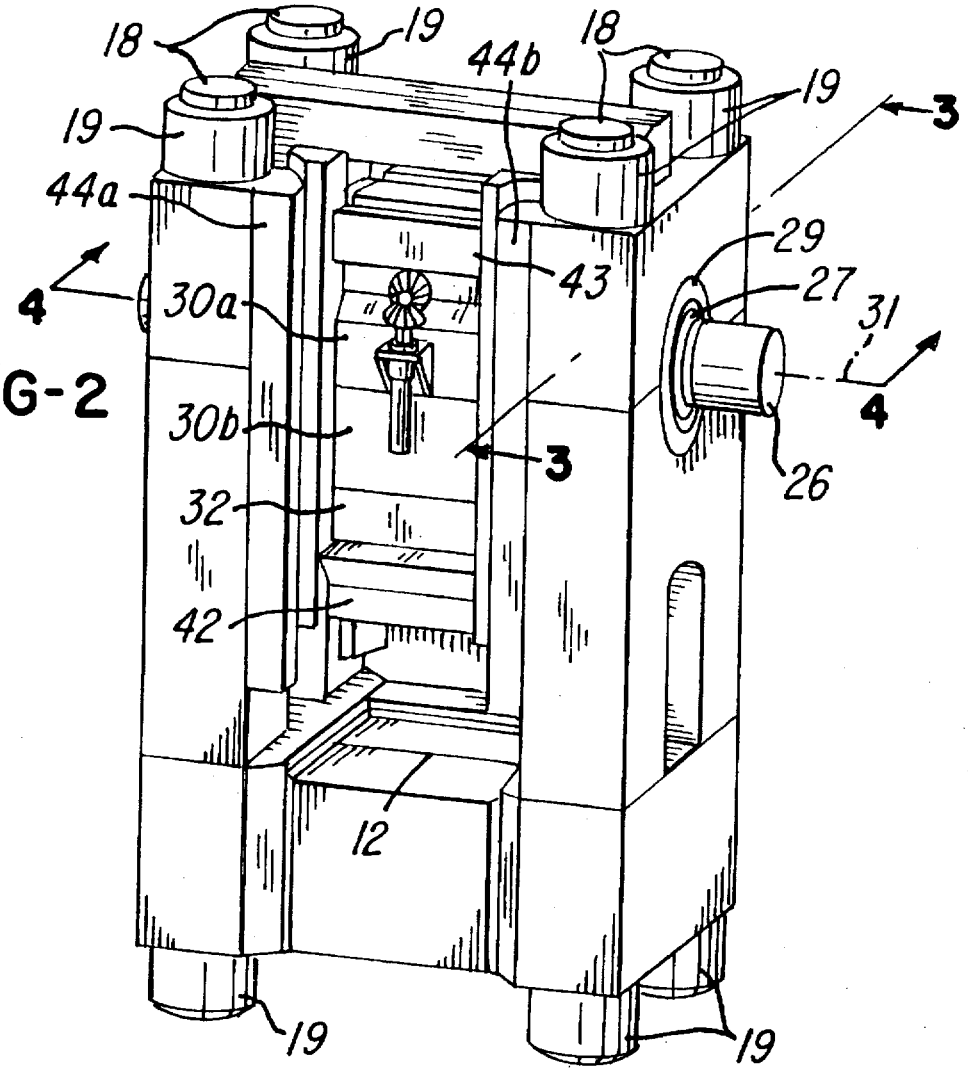
FIG. 2 is a perspective view of a portion of the forging press including the frame members, press bed, and yoke and ram assembly.
Figure 2A:
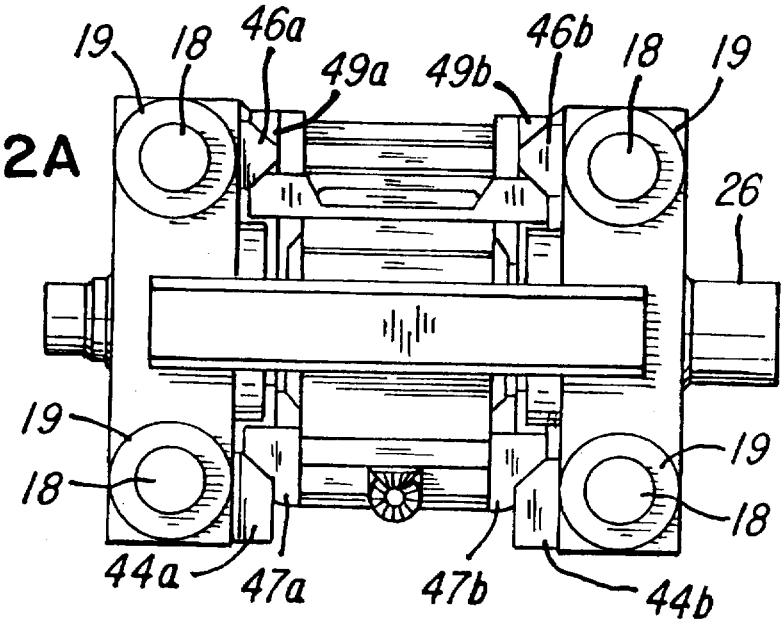
FIG. 2A is a top plan view of the portion of the press shown in FIG. 2.

As shown in FIG. 2A, the ram 32 includes upright forward guides or liners 44*a*, 44*b* and upright V-shaped rear guides and liners 46*a*, 46*b*. The guides 44*a*, 44*b* and 46*a*, 46*b* cooperate with mutually opposing guide surfaces or gibs 47*a*, 47*b* and 49*a*, 49*b*, respectively, of the upright frame members 14, 16 to guide the ram assembly 32 in vertical movement as the ram 32 is driven by the yoke 24 and eccentric portion 36 of the shaft 26 during a forging operation.

Referring to FIG. 3, during rotation of the shaft 26 the yoke assembly 24 operates to transmit forging forces across substantially the entire surface of the platen 42. With the press ram 32 at the bottom of a forging stroke, the yoke block 30 is centered within the press ram 32 on top of the platen 42, and the eccentric portion 36 of the shaft 26 is located downwardly from the shaft 26. As the shaft 26 and eccentric portion 36 rotate in the direction of arrow A, the block 30 is urged in the direction of arrow B to an extreme forward position, and the press ram 32 moves upwardly on the guides 44*a*, 44*b* and 46*a*, 46*b* through half of an upward stroke to move the ram 32 in the direction of arrow C.

As the shaft 26 continues to rotate in the direction of arrow A, the yoke block 30 is urged back to the center of the press ram 32 and the ram 32 reaches the top of its stroke. Further rotation of the shaft 26 causes the yoke block 30 to slide relative the ram 32 in the direction of arrow D and drives the ram 32 downwardly in the direction of arrow E to perform a forging stroke. FIG. 3 illustrates the ram 32 at the bottom of its forging stroke.

It should be appreciated that the eccentric portion 36 transmits forging forces substantially uniformly across the entire surface of the press ram 32 such that the press ram 32 is less like to skew or deflect during a downward forging stroke, thus enabling the press to produce higher quality and higher precision forged parts.

Figure 4:
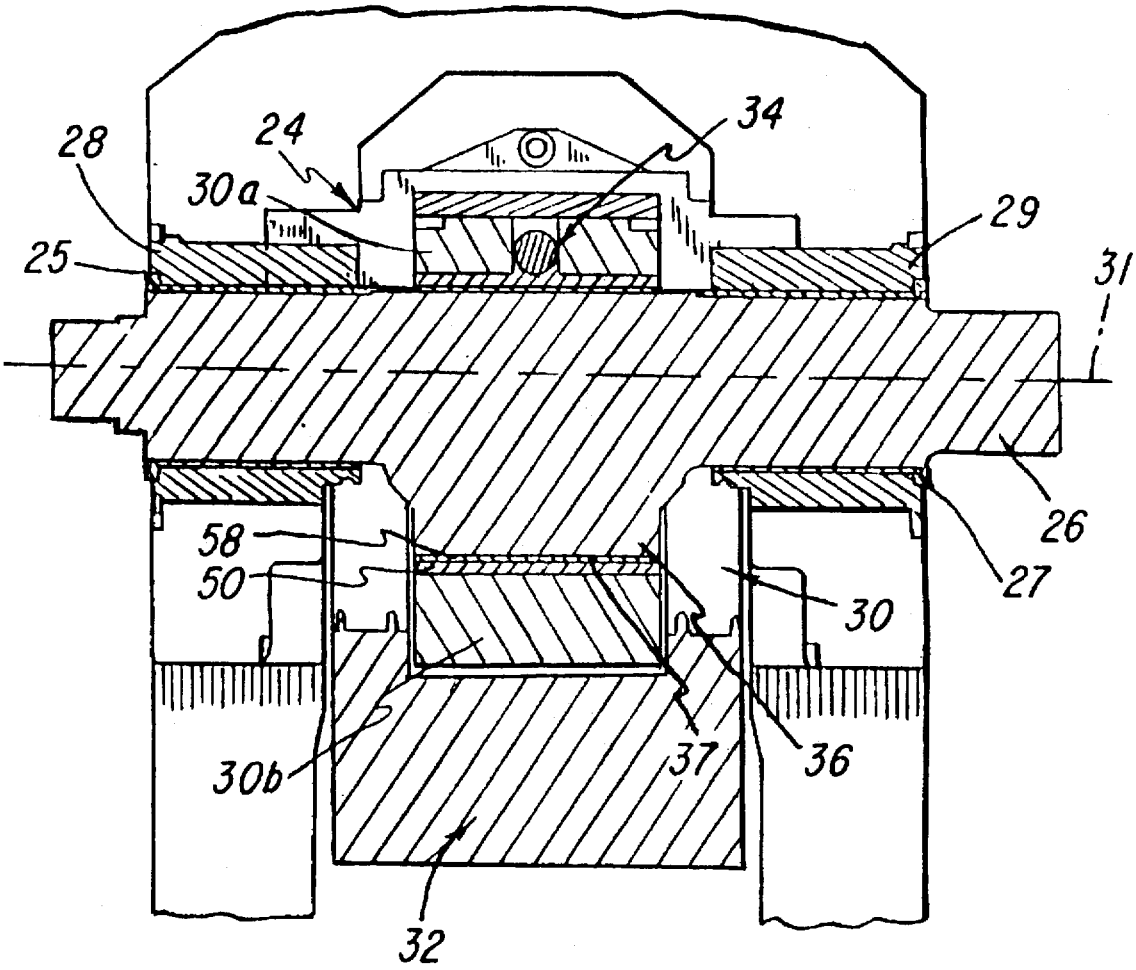
FIG. 4 is an elevational cross-sectional view of the yoke and ram assembly taken along line 4—4 in FIG. 2.
Figure 5:
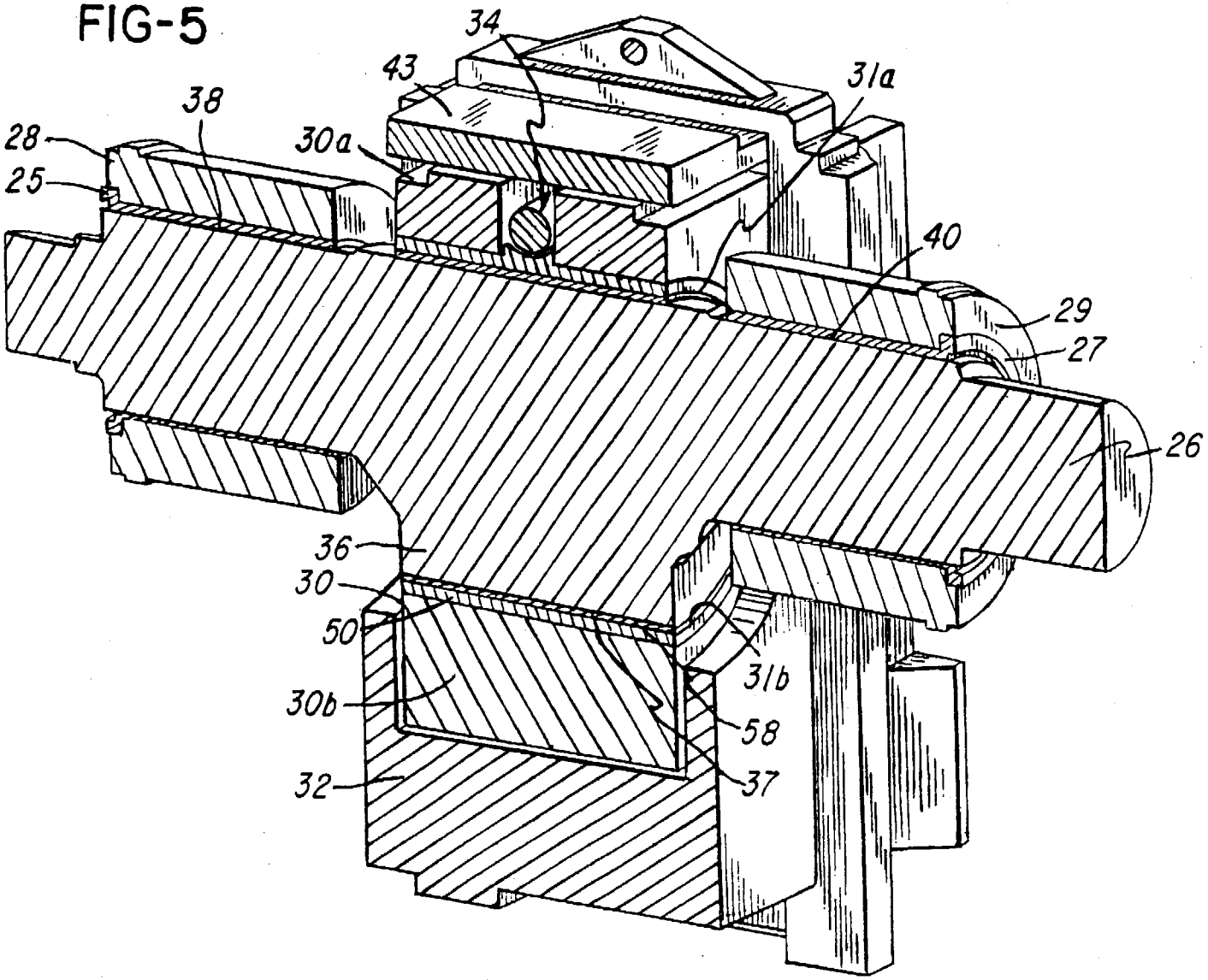
FIG. 5 is a perspective cross-sectional view of the yoke and ram assembly taken through the longitudinal center of the assembly.

As seen in FIGS. 3–5, the shut height adjustment assembly or sub-system 34 includes a rotatable eccentric spacer bearing 50 surrounding the eccentric portion 36 of the shaft 26, and a worm gear or screw 52 mounted to the upper block half 30*a* and meshing with a toothed upper arcuate surface 53 of the eccentric spacer bearing 50. A driver 48, such as a motor, is mounted to the upper block half 30*a* and is mechanically coupled to the worm gear 52 via meshed bevel gears 54, 56, respectively, of the driver 48 and worm gear 52. In the embodiment being described, the driver 48 is controlled by a programmable logic controller (PLC) based control system as discussed further below.

It should be noted that an inner surface of the eccentric spacer bearing 50 is lined with a conventional bronze bearing 58 which contacts the eccentric portion 36 of the shaft 26. The outer surface of the eccentric spacer bearing 50 contacts arcuate surfaces 31*a*, 31*b* (FIG. 3) of the slider block halves 30*a*, 30*b*. The outer surface of the eccentric spacer bearing 50 is eccentrically offset from the inner surface of the spacer bearing 50 such that the thickness of the eccentric spacer bearing 50 varies around the circumference thereof.

The shut height adjustment sub-system 34 permits the forging stroke of the press ram 32 to be adjusted via PLC computer control so as to automatically compensate for the height characteristics of the forging dies secured to the press bed 12. More particularly, the shut height adjustment sub-system 34 varies the relative distance separating the lower surface of the press ram 32 from the forging die prior to, or between forging strokes of the press ram 32. Automated shut height adjustment is an important feature to flexible manufacturing operations because it permits the press 10 to be reconfigured to operate with different forging dies. In its most simple form, the shut height adjustment sub-system 34 provides means for fine tuning the stroke of the press ram 32 independent from the rotation of the shaft 26.

Thus, during a shut height adjustment operation, the worm gear 52 rotates the eccentric spacer bearing 50 relative to the eccentric portion 36 of the shaft 26 and the slider block halves 30*a*, 30*b*. As the spacer bearing 50 is rotated, its eccentricity causes the vertical position of the yoke block 30 to be adjusted upwardly or downwardly relative to the eccentric portion 36 to thereby increase or decrease the shut height of the press.

The amount of shut height adjustment depends upon the amount of rotation of the eccentric spacer bearing 50. This adjustment is controlled by an encoder (not shown) on the driver 48. A control is provided through a PLC-based control system and an operator interface 60 (FIG. 1) to select the amount and direction of shut height adjustment which is signalled to the driver 48. After a forging stroke of the press ram 32 has been completed a kickout sub-system 33 is actuated to eject forged parts from the dies associated with the press bed 12.

As best seen in FIG. 1, the kickout sub-system 33 comprises a hydraulic power unit (not shown) and one or more hydraulic cylinders 62 which directly actuates a lower knockout pin or ejector 64 (FIG. 1) recessed within a corresponding aperture or bore 66 in the press bed 12. In the embodiment being described, the kickout sub-system 33 accommodates a plurality of forging dies providing up to five separately operable sets of hydraulic cylinders 62, knockout pins 64, and apertures 66 (FIG. 6) to independently eject forged parts from five in-line forging stations defined in the bottom main bolster 70.

The bottom main bolster and associated dies 70 include apertures or bores which communicate with respective knockout pin apertures 66. The apertures in the main bolster 70 cooperate with the apertures 66 to permit the knockout pins 64 to contact, and thus eject, the forged parts disposed within the respective forging stations.

The kickout sub-system 33 is controlled by a PLC-based control system which permits the kickout speed, length of kickout stroke and amount of time delay before actuating the knockout pin 64 to be automatically adjusted. Further, the hydraulic kickout sub-system 33 is more flexible than previous mechanical linkage kickout systems because mechanical kickout systems typically include a mechanical linkage which is very prone to wear and is responsible for frequent press down time.

In order to accommodate multiple in-line forging stations, the bed 12 of the press 10 is substantially enlarged relative to previous designs. It is to be understood that a forging die having any number of forging stations could be utilized with the press 10 of the present invention in an equivalent manner.

Figure 6:
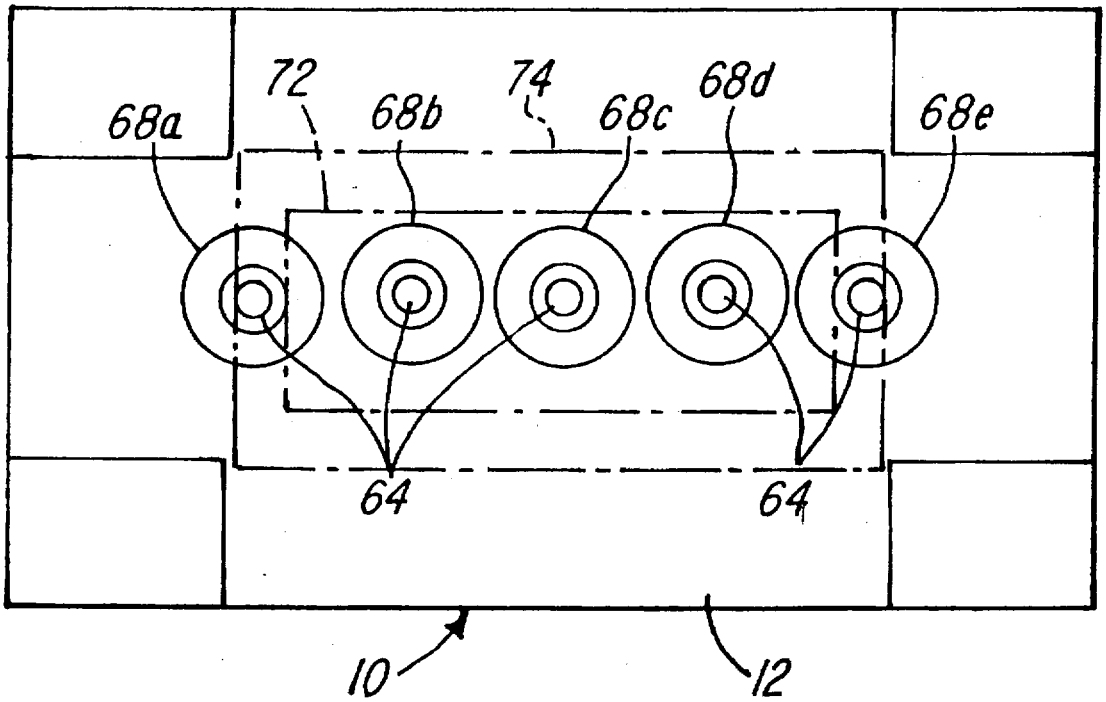
FIG. 6 is a diagrammatic top plan view of the press bed illustrating the distribution of tonnage on die stations located in the press.
Figure 7:
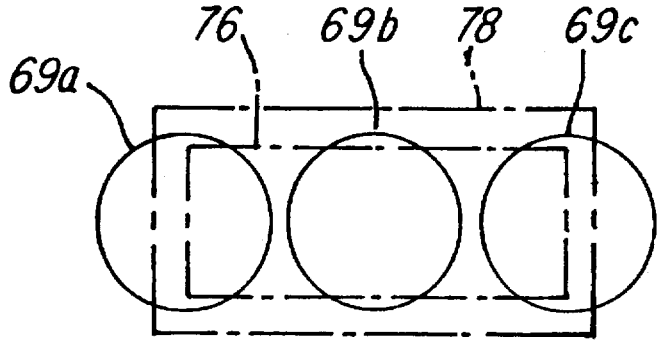
FIG-7 (PRIOR ART)
FIG. 7 is a top plan view similar to FIG. 6 and illustrating tonnage distribution for a prior art press.

Referring now to FIG. 6, the press 10 of the present invention provides tonnage zones that are larger than conventional tonnage zones in order to provide sufficient forging pressure to each in-line forging station 68*a*–68*e* defined by dies located on the bottom main bolster 70. The press 10 provides an enlarged bed 12 having a full or 100% tonnage zone 72 which completely covers the three central forging stations 68*b*–68*d*, and partially covers the end forging stations 68*a*, 68*e*. In addition, a 60% peripheral tonnage zone 74 surrounds the 100% tonnage zone 72 and also partially covers the end forging stations 68*a*, 68*e*.

It should be noted that the means providing the enlarged tonnage zone includes the provision of a wider eccentric portion 36 than is found on prior art presses. Thus, the width of the eccentric portion 36 is such that it provides full tonnage to the dies located at central stations 68*b*–68*d* of the press 10. In addition, the wider eccentric portion 36 provides additional rigidity to reduce deflection of the shaft 26.

Figure 13:
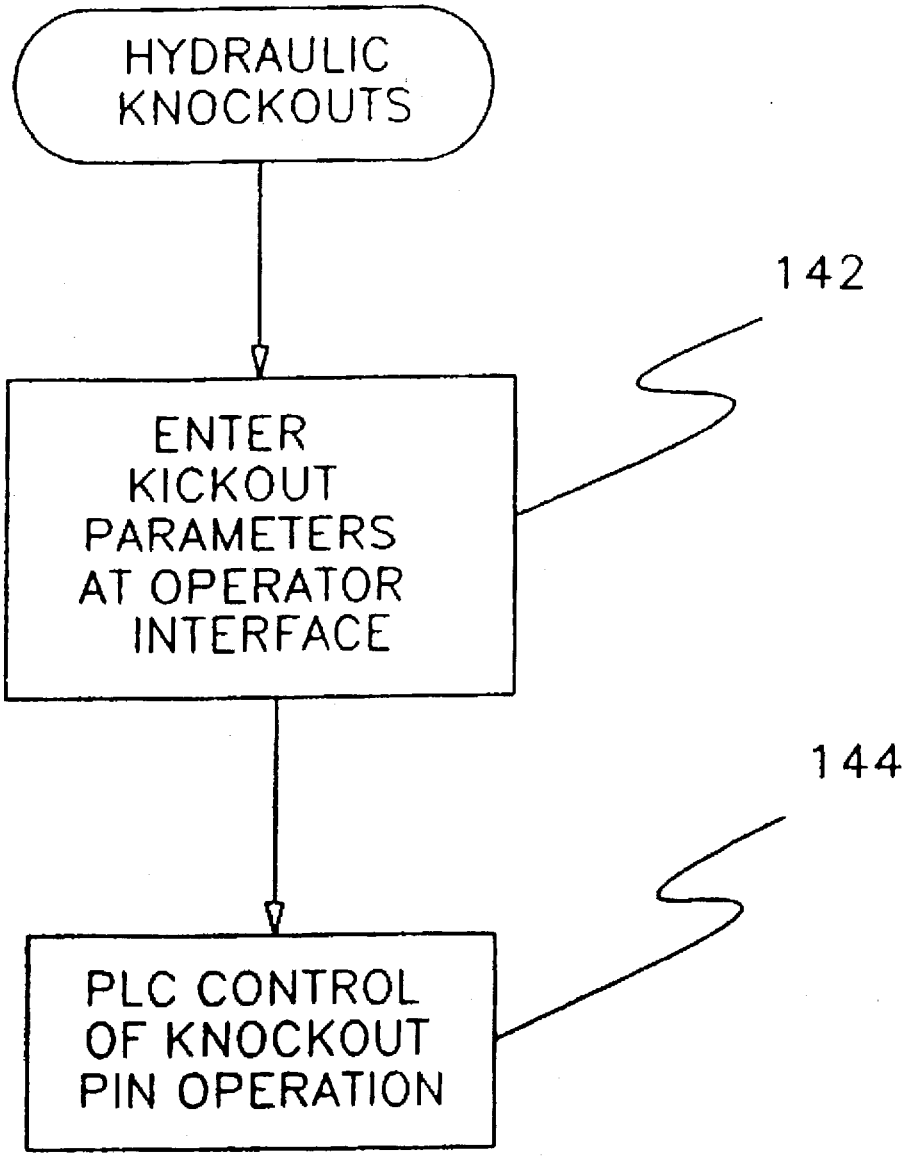
FIG. 13 is a flowchart illustrating the operational control of a hydraulic kickout sub-system of the forging press.

By way of example, a 3000-ton forging press 10 of the present invention provides an enlarged bed 12 supporting dies at stations 68*a*–68*e* located on 10 inch centers. The full tonnage zone 72 of the press is approximately 504 square inches (36 in.×14 in.), and a 60% tonnage zone 74 of the press is approximately 420 square inches (42 in.×22 in.–54 square in.) surrounding the full tonnage zone 72. In contrast, conventional presses typically provide beds having a full tonnage zone 76 (FIG. 13) which can only partially cover three forging stations 69*a*–69*c* with an area of approximately 160 square inches (20 in.×8 in.). Further, conventional press designs typically provide beds with a 60% tonnage zone 78 which, like the full tonnage zone 76, only partially covers the three forging stations 69*a*–69*c* with an area of approximately 116 square inches (23 in.×12 in.–160 square in.).

Figure 8:
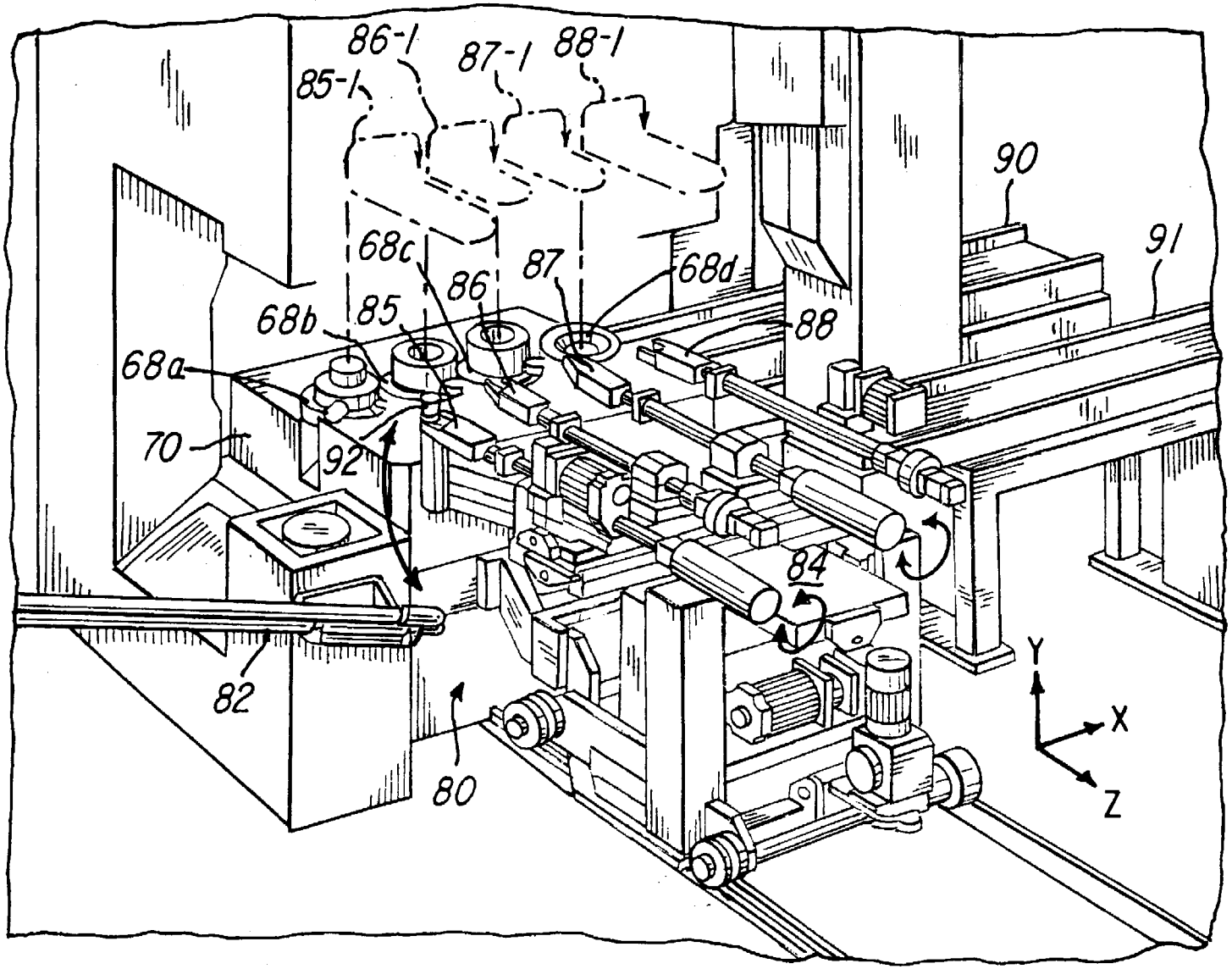
FIG. 8 is a perspective view of a forging press constructed in accordance with the present invention and incorporating a transport sub-system.

As best seen in FIG. 8, the press 10 operates in conjunction with an automated multi-station transport sub-system 80 to progressively move parts through a plurality of forging stations whereby parts may be formed by forging in successive die stations 68*a*–68*d*. It should be understood that although only four of the die stations 68*a*–68*d* are illustrated, additional stations may be provided within the scope of the present invention. For example, five die stations may be provided, as depicted in FIG. 6.

The multi-station transport sub-system 80 is a multi-axis system which permits bidirectional movement in three axes, namely, the X-axis, Y-axis and Z-axis. The transport sub-system 80 is operated under the control of the PLC-based control system discussed below, and can be driven either hydraulically, or by electric servomotors.

The transport sub-system 80 includes a robotic feeder arm 82, a robotic transfer unit 84 having a plurality of transfer arms 85, 86, 87, 88, which move along paths illustrated diagrammatically by broken lines 85-1, 86-1, 87-1 and 88-1 located above the respective arms 85, 86, 87 and 88. In addition, a take-away conveyer or conveyors 90, 91 are provided to convey completed parts from the press 10. The feeder arm 82 feeds a heated ingot 92 to the first forging station 68*a* under the control of the PLC-based control system. The robotic transfer unit 84 and the transfer arms 85, 86, 87, 88 cooperate, under control of the PLC-based control system, to progressively transfer ingots through the remaining forging stations 68*b*–68*d* for further processing before depositing a finished part 94 on a take-away conveyer 90, 91.

Figure 9:
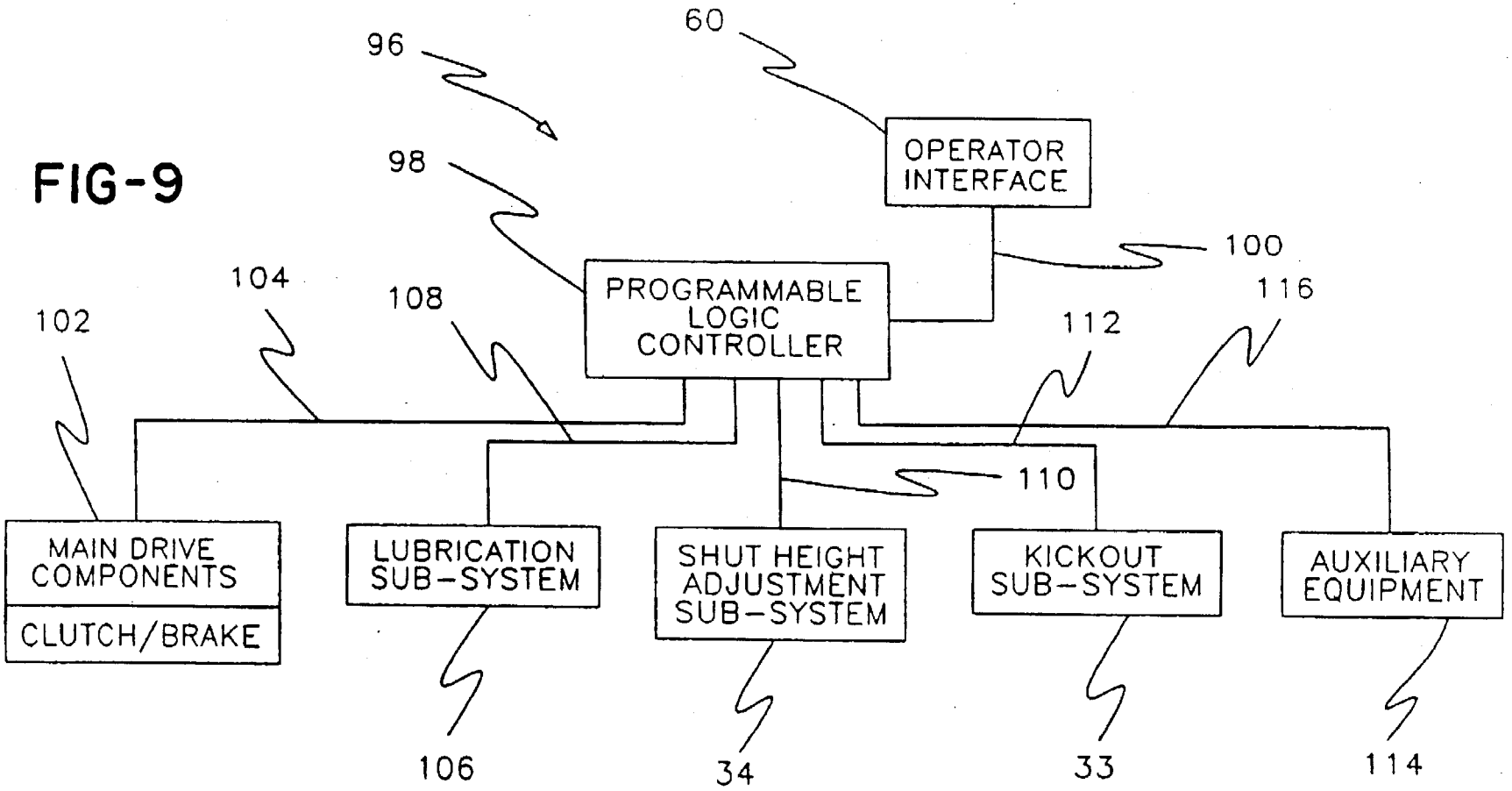
FIG. 9 is a block diagram of a programmable logic controller-based control system for controlling the forging press of the present invention.

Referring now to FIG. 9, there is shown a block diagram of a conventional programmable logic controller-based control system 96 of the present invention. The control system 96 includes a programmable logic controller (PLC) 98 which (1) communicates with the operator interface 60 via a communication line 100; (2) communicates with the main drive components of the press 10 such as a clutch and a brake shown generally as 102 via a communication line(s) 104; and (3) communicates with a plurality of automated sub-systems such as a lubrication sub-system 106, the shut height adjustment sub-system 34, and the kickout sub-system 33 via communication lines 108, 110, and 112, respectively, during a forging cycle of the press 10.

Further, the PLC 98 is capable of communicating with customer auxiliary equipment shown generally as 114 via communication line(s) 116 to provide additional flexibility to integrate other equipment with the press 10 such as the automated multi-station transport sub-system 80 discussed above. In the embodiment being described, a conventional PLC 98 is utilized to communicate in a conventional manner with the operator interface, the main drive components, and the press sub-systems. One suitable PLC is known commercially as SLC 5/04 and is available from Allen Bradley.

Figure 10:
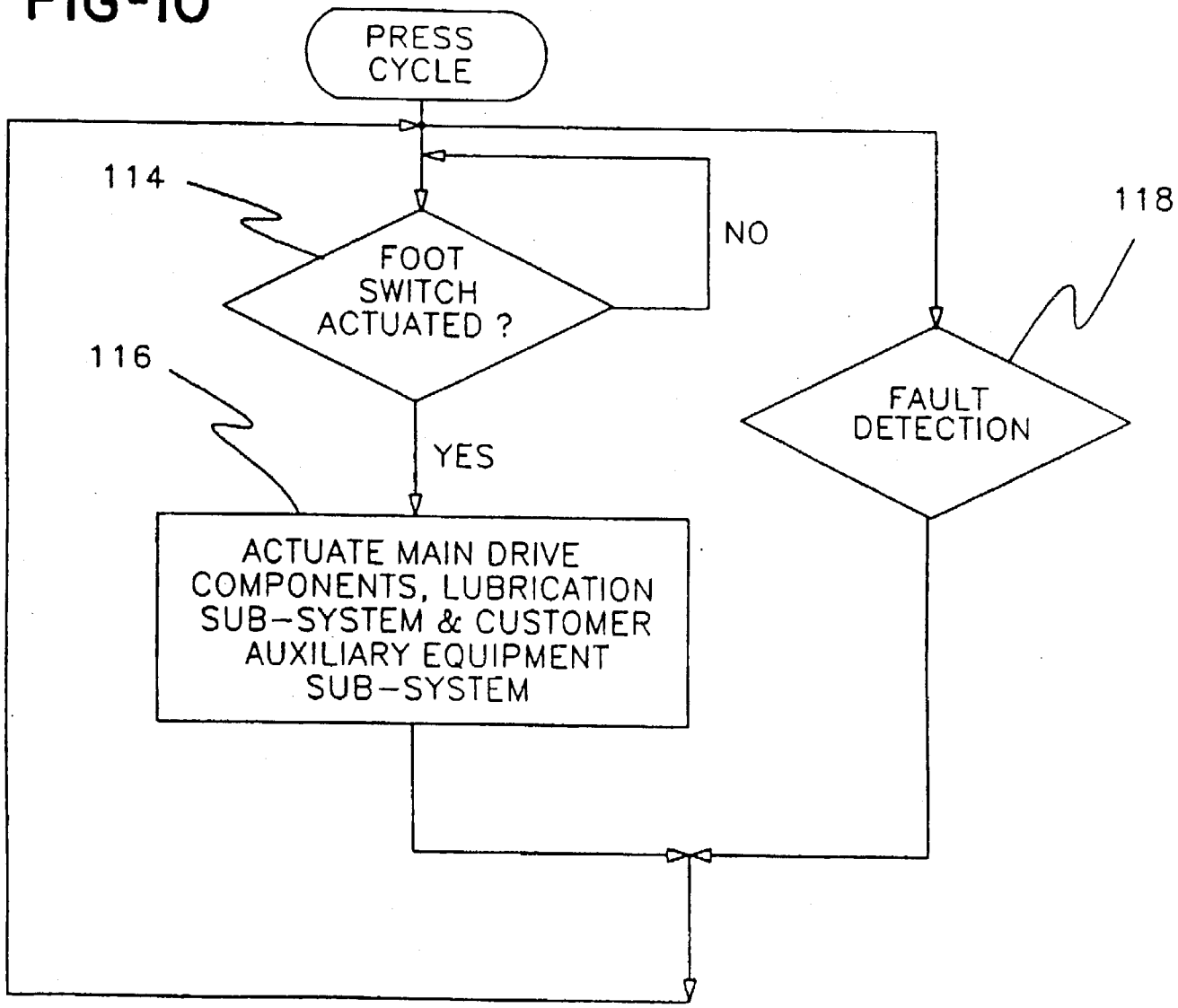
FIG. 10 is a flowchart illustrating the operational control of a forging cycle of the forging press.

Referring now to FIG. 10, there is shown a flowchart illustrating a forging cycle routine of the press 10. A press operator initiates a forging cycle by depressing a foot switch (not shown). The control system 96 detects actuation of the foot switch at step 114. Once the forging cycle is initiated, the routine advances to step 116 wherein control of the main drive components 104, the lubrication sub-system 106, kickout sub-system 33, and customer auxiliary equipment sub-system 114 (if present) occurs. If the control system 96 detects the occurrence of a system fault prior to initiating a forging cycle, the routine advances to a fault correction sub-routine at step 118 before returning to step 114 in the forging cycle routine.

Figure 11:
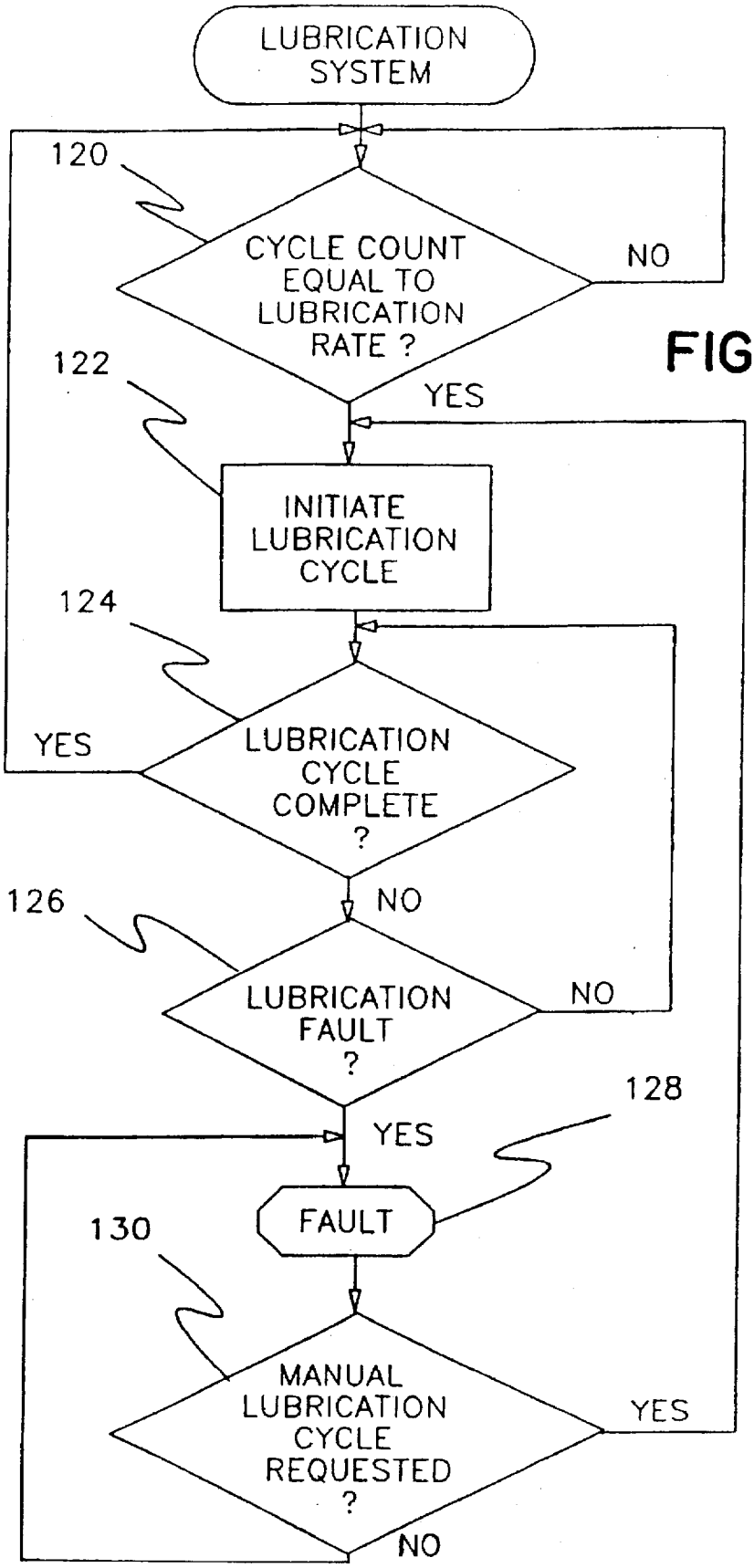
FIG. 11 is a flowchart illustrating the operational control of a lubrication sub-system on the forging press.

FIG. 11 illustrates a lubrication sub-system routine. Initially, a programmable lubrication rate variable is compared with a forging cycle count at step 120. When the forging cycle count equals the lubrication rate variable, the routine advances to step 122 where an initiate lubrication cycle command is generated. The routine then polls the lubrication sub-system 106 at step 124 to determine whether the lubrication cycle is complete. If the cycle is complete, the routine returns to step 120. If the lubrication cycle is not complete, the routine advances to step 126 to determine whether a lubrication fault has occurred. If a fault is detected, a fault is declared at step 128 and the operator is polled at step 130 to initiate a lubrication cycle. Once the operator requests a lubrication cycle at step 130, the routine then advances to step 122. Otherwise, the routine loops between steps 128 and 130 until the fault is corrected.

Figure 12:
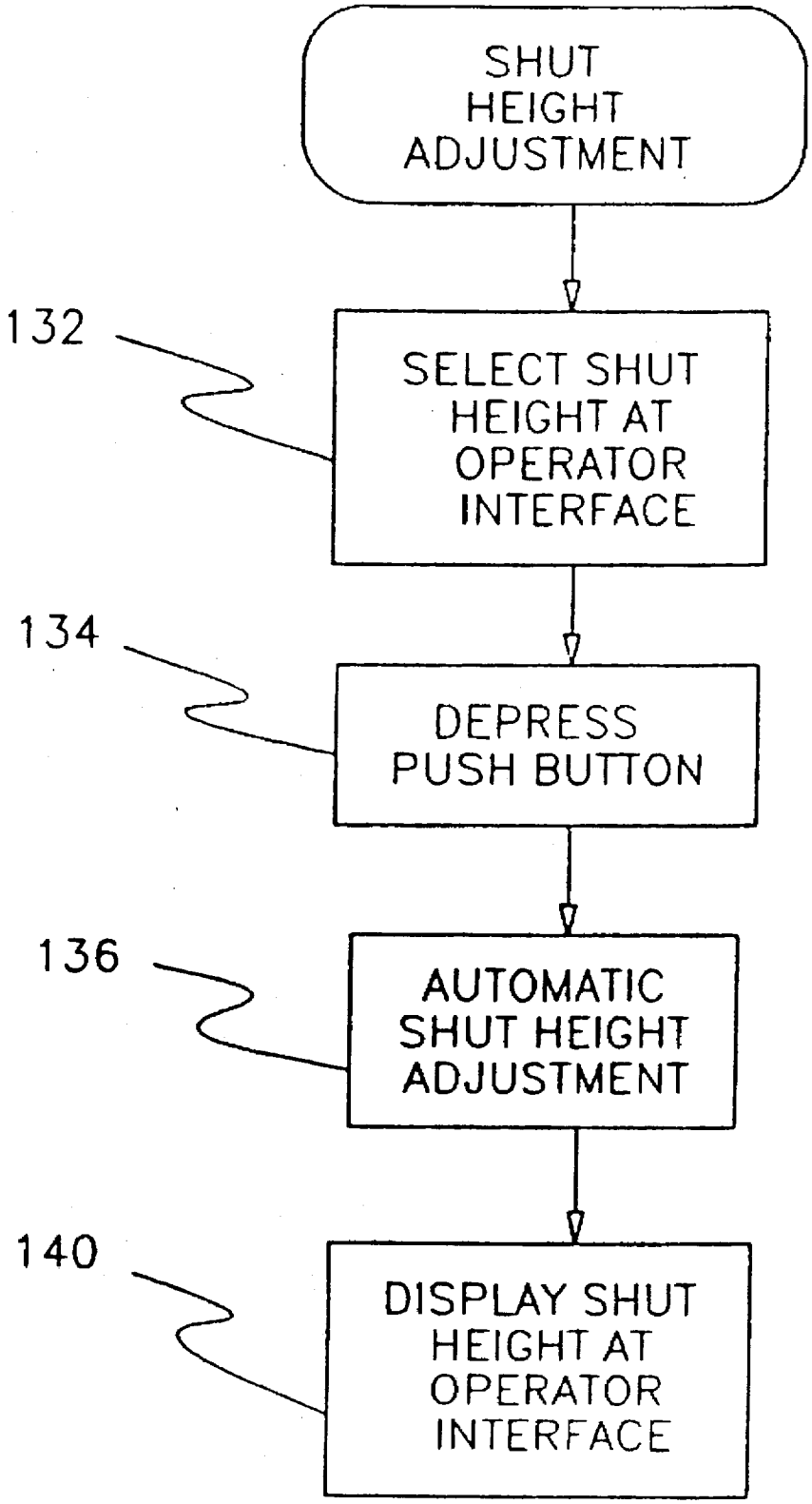
FIG. 12 is a flowchart illustrating the operational control of a shut height adjustment sub-system of the forging press.

FIG. 12 illustrates a shut height adjustment sub-system routine for controlling the shut height sub-system 34. Initially, at step 132, a programmable shut height variable is entered by the operator at the operator interface 60. Once a push button is depressed at step 134, the shut height is automatically adjusted at step 136 as described above. After the shut height has been adjusted, the routine advances to step 140 where the new shut height parameter is displayed at the operator interface 60.

FIG. 1 illustrates a kickout sub-system routine for controlling the kickout sub-system 33. Initially, at step 142, the operator enters programmable kickout parameters such as kickout speed, length of kickout stroke and the amount of time delay before actuating the knockout pins 64. Once entered, the routine advances to step 144 wherein the hydraulic power unit (not shown) and the hydraulic cylinders 62 are controlled to actuate the lower knockout pins 64 in accordance with the entered parameter(s).

While the forms of the device herein described constitute the preferred embodiments of the invention, it is to be understood that the invention is not limited to these precise forms of device, and that changes may be made therein without departing from the scope of the invention which is defined in the appended claims.

What is claimed is:

1. A forging press comprising:

a bed supporting a plurality of lower dies;

a ram supporting a plurality of upper dies;

a drive mechanism for driving said ram vertically toward and away from said bed;

a transfer system for moving workpieces through said press between said dies; and a programmable controller connected to said transfer system for controlling said transfer system, comprising a kickout system including kickout pins for pushing workpieces out of said dies, and said programmable controller is connected to said kickout system to control actuation of said kickout pins; and wherein said programmable controller is programmable to adjust the stroke and speed of said kickout pins.

2. The press as recited in claim 1 wherein said ram is driven in vertical movement by a rotating shaft and said adjustment system adjusts a position of said ram relative to said shaft.

3. The press as recited in claim 2 including a yoke assembly engaged with said ram, wherein said shaft includes an eccentric portion engaged with said yoke assembly for driving said yoke assembly and said ram in vertical movement.

4. The press as recited in claim 3 wherein said yoke assembly includes an eccentric bearing and means for positioning said eccentric bearing relative to said yoke.

5. The press as recited in claim 4 wherein said means for positioning said eccentric bearing relative to said yoke comprises a drive motor mounted to said yoke and operably connected to said eccentric bearing for rotating said bearing.

6. The press as recited in claim 5 wherein said eccentric bearing surrounds an eccentric portion of said shaft.

7. The press as recited in claim 5 wherein said eccentric bearing includes a toothed surface and said drive motor drives a worm gear engaged with said toothed surface to rotate said eccentric bearing.

8. The press as recited in claim 1 including a programmable controller connected to said adjustment system for selectively adjusting the shut height of said ram.

9. The press as recited in claim 1 including a plurality of die stations and a transfer system for automatically transferring workpieces between said die stations.

10. The press as recited in claim 9 including a programmable controller connected to said transfer system for automatically controlling operation of said transfer system.

11. The press as recited in claim 10 wherein said programmable controller is connected to said adjustment system for selectively adjusting the shut height of said ram.

12. The press as recited in claim 1 comprises a plurality of die stations, each said die station including a die, and a full tonnage zone for said press which covers at least an entire one of said dies and a portion of all the dies.

13. The press as recited in claim 12 wherein said full tonnage zone covers at least three dies in their entirety.

14. The press as recited in claim 13 wherein said full tonnage zone further partially covers an additional two dies.

15. The press as recited in claim 1 wherein said programmable controller is connected to said drive mechanism to control a forging cycle.

16. The press as recited in claim 1 including an adjustment system to adjust the shut height of said ram relative to said bed wherein said programmable controller is connected to said adjustment system for selectively controlling the shut height of said ram.

17. The press as recited in claim 16 wherein said drive mechanism comprises a shaft including an eccentric portion and a yoke surrounding said eccentric portion, and said adjustment system is mounted to said yoke.

18. A method of operating a forging press having a press bed for supporting a plurality of lower dies, a vertically movable ram for supporting a plurality of upper dies and a drive mechanism for driving said ram in vertical movement, said method comprising the steps of:

providing a transport system for transporting workpieces between dies;

providing a programmable controller connected to said transport system;

programming said controller to move workpieces between said dies at predetermined times; and actuating said transport system during a forging operation to move said workpieces;

including providing a kickout system associated with said dies to push parts out of said dies wherein said controller is connected to said kickout system, and including the step of said controller actuating said kickout system to push parts out of said dies;

including the step of programming said controller to select a kickout speed, kickout sequence and kickout throw for said kickout system.

19. The method as recited in claim 18 wherein said controller is connected to said drive mechanism, and including the step of said controller causing said drive mechanism to be actuated to perform a forging operation.

* * * * *